United States Patent [19]

Oya

[11] Patent Number: 5,025,702

[45] Date of Patent: Jun. 25, 1991

[54] ELECTRONIC MUSICAL INSTRUMENT EMPLOYING TIME-SHARING FREQUENCY MODULATION AND VARIABLE CONTROL OF HARMONICS

[75] Inventor: Akiyoshi Oya, Hamamatsu, Japan

[73] Assignee: Yamaha Corporation, Hamamatsu, Japan

[21] Appl. No.: 439,006

[22] Filed: Nov. 21, 1989

Related U.S. Application Data

[60] Division of Ser. No. 922,883, Jul. 7, 1978, Pat. No. 4,643,066, which is a continuation of Ser. No. 700,941, Jun. 29, 1976, abandoned, and a continuation of Ser. No. 109,084, Oct. 15, 1987, abandoned, which is a division of Ser. No. 748,732, Jun. 25, 1985, Pat. No. 4,748,888.

[30] Foreign Application Priority Data

Jul. 3, 1975 [JP] Japan ..... 50-82208
Jul. 3, 1975 [JP] Japan ..... 50-82209

[51] Int. Cl.[5] ..... G10H 1/14
[52] U.S. Cl. ..... 84/659; 84/696
[58] Field of Search ..... 84/622-625, 84/659, 660, 696, 735

[56] References Cited

U.S. PATENT DOCUMENTS 3,007,361 11/1961 Wayne ..... 84/1.01
3,510,565 5/1970 Morez ..... 84/1.25 X
3,610,799 10/1971 Watson ..... 84/1.01
4,018,121 4/1977 Chowning ..... 84/1.01

OTHER PUBLICATIONS

B. P. Lathi, *Communications Systems*, © 1968 by John Wiley & Sons, Inc., pp. 210-214.

*Primary Examiner*—Stanley J. Witkowski
*Attorney, Agent, or Firm*—Spensley Horn Jubas & Lubitz

[57] ABSTRACT

In this electronic musical instrument a musical tone is generated by frequency modulation employing a carrier wave and a modulating wave. Plural tone production channels are employed and a key assigner assigns production of a tone corresponding to a depressed key to an available channel. Tone production is achieved by a frequency modulation operation carried on in a time-shared manner for each channel. In order to achieve complex variation in harmonic content of the tone signal which is generated, the frequency of the carrier wave varies with the passage of time.

11 Claims, 9 Drawing Sheets

ELECTRONIC MUSICAL INSTRUMENT EMPLOYING TIME-SHARING FREQUENCY MODULATION AND VARIABLE CONTROL OF HARMONICS

RELATED APPLICATIONS

This is a continuation of co-pending application Ser. No. 07/109,084, filed on Oct. 15, 1987 and now abandoned, which is a division of my copending U.S. patent application Ser. No. 06/748,732, filed on Jun. 25, 1985 and now U.S. Pat. No. 4,748,888, and a division of Ser. No. 05/922,883, filed on Jul. 7, 1978 and now U.S. Pat. No. 4,643,066, which is a continuation of Ser. No. 05/700,941, filed on Jun. 29, 1976 and now abandoned.

BACKGROUND OF THE INVENTION

This invention relates to an electronic musical instrument capable of producing a musical tone by utilizing a frequency modulation system.

Various proposals have been made for producing a musical tone by an electronic musical instrument. These proposals include, for example, a system according to which a musical tone waveform for producing a certain tone colour is memorized in a memory and the waveform is successively read from the memory, a system according to which a desired tone colour is obtained by filtering a tone source waveform containing abundant harmonic components through a filter for attenuating some harmonic components, and a system according to which harmonics of respective orders are individually and separately produced and amplitude of each harmonic component is individually controlled to produce a desired tone colour. These prior art electronic musical instruments, however, have limitation in the scope of variation of the tone colour. It is particularly difficult in the prior art instruments to produce a musical tone which contains harmonic components of interger and non-integer orders at complicated ratios which varies with time.

SUMMARY OF THE INVENTION

It is, therefore, an object of the present invention to provide an electronic musical instrument capable of producing, on the basis of a system which is entirely different from the systems employed in the prior art instruments, a musical tone containing harmonic components of integer and non-integer orders at complicated ratios which evolve with time.

It is another object of the invention to produce a musical tone signal in real time upon depression of a key on the keyboard by generating a carrier phase component and a modulating wave phase component in real time in response to the depression of the key and effecting computation of frequency-modulation on the basis of these phase components.

It is another object of the invention to produce a plurality of musical tones simultaneously by utilizing the frequency modulation system. To accomplish this, assignment means are provided for detecting depressed keys and assigning tones corresponding to the depressed keys to any of a predetermined plurality of tone generation channels. Carrier and modulation waves are generated in a time-sharing manner for each channel to enable plural musical tones to be simultaneously generated.

It is another object of the invention to produce a musical tone signal of an accurate pitch by specially adding a fundamental wave component to the musical tone signal since the fundamental wave component in some cases is lost during frequency modulation depending upon the value of modulation index as will be described later.

It is still another object of the invention to realize a very complicated tone colour variation by varying the carrier, the modulating wave and the modulation index used in the frequency modulation with time and also obtain a close simulation of a tone colour change occurring during attack and decay of a natural musical tone by controlling the variation in the tone colour in accordance with depression and release of the key. By varying the frequency of the carrier wave with time, variation in the types of harmonics and relative levels of harmonics can be achieved.

These and other objects and features of the invention will becomes apparent from the description made hereinbelow with reference to the accompanying drawings.

BRIEF DESCRIPTION OF THE DRAWINGS

In the accompanying drawings.

PRINCIPLE OF GENERATION OF MUSICAL TONES BY THE FM SYSTEM

The principle of generation of musical tones by the FM system according to the invention will now be described.

The generation of musical tones by the FM system utilizes the fact that a frequency modulated signal contains a multiplicity of side frequencies and there is a common characteristic between a frequency modulated signal composed of these side frequencies and a musical tone signal consisting of a multiplicity of harmonic components. According to this system, a musical tone signal is synthesized by effecting frequency modulation in the audio range.

A frequency modulated signal e is generally expressed by the following equation (1):

$$e=A \sin(\alpha t+I \sin \beta t) \quad (1)$$

where $\alpha$ represents angular frequency of a carrier wave, $\beta$ angular frequency of a modulating wave, I modulation index, A peak amplitude and t time.

The above equation (1) is evolved to obtain the following equation (2):

$$\begin{aligned} e - A\{&J_0(I) \sin\alpha t + \\ &J_1(I)[\sin(\alpha+\beta)t = \sin(\alpha-\beta)t] + \\ &J_2(I)[\sin(\alpha+2\beta)t + \sin(\alpha-2\beta)t] + \\ &J_3(I)[\sin(\alpha+3\beta)t - \sin(\alpha-3\beta)t] + \\ &J_4(I)[\sin(\alpha+4\beta)t + \sin(\alpha-4\beta)t] + \ldots\} \end{aligned} \quad (2)$$

Figure 1:
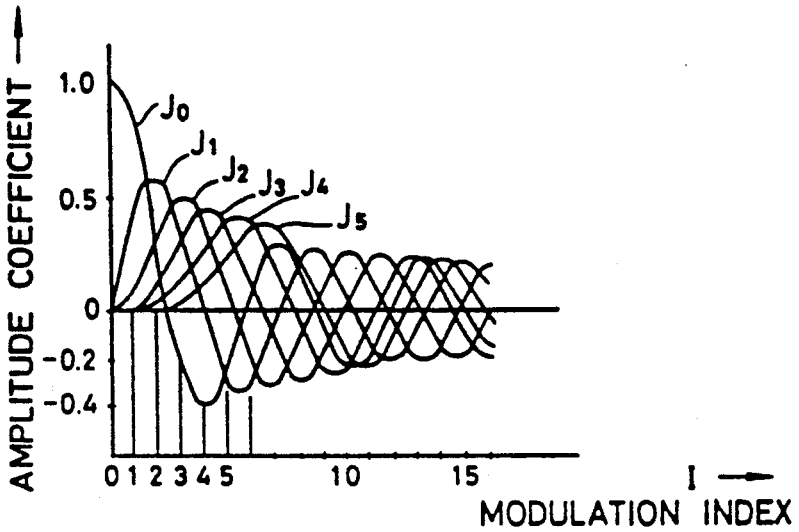
FIG. 1 is a graphical diagram showing examples of Bessel functions.

It will be apparent from the equation (2) that the signal e consists of a number of side frequencies $\alpha\pm\beta$, $\alpha\pm2\beta$, $\alpha\pm3\beta$ and so forth. Bessel functions $J_o(I)$, $J_1(I)$, $J_2(I)$, $J_3(I)$ etc. of modulation index I are coefficients which determine amplitudes of the carrier and side frequencies. Each of the Bessel functions is preceded by a positive or negative sign depending upon the value of modulation index I. Bessel functions $J_0(I)$ through $J_5(I)$ for the carrier and the first to the fifth order side frequencies are shown in FIG. 1. From the figure it will be noted that the Bessel functions $J_0(I)-J_n(I)$ are preceded by a positive sign within a range where modulation index I is below about 2.5 and either by a positive or negative sign if modulation index exceeds about 2.5. It will also be understood from the equation (2) that upper and lower side frequencies of odd number orders are preceded by mutually different signs. This signifies that phase inversion occurs in side frequencies of the modulated signal wave e represented by the equation (2) (=equation (1)).

Figure 2:
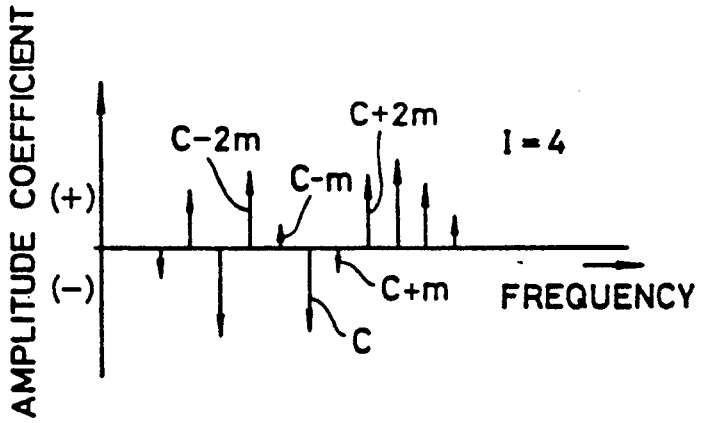
FIG. 2 is a graphical diagram showing a spectrum of side frequencies when modulation index $1=4$.

By way of example, the amplitude coefficients for side frequencies of respective orders when modulation index I is 4 are $J_0(I)=-0.4$, $J_1(I)=-0.05$, $J_2(I)=0.35$, $J_3(I)=0.42$, $J_4(I)=0.3$, $J_5(I)=0.15$ respectively. The frequency spectrum for this example is shown in FIG. 2 in which C represents the carrier frequency and m the modulating frequency. The frequencies of negative amplitude coefficients are simply inverted in phase and this phase inversion has not significant importance unless there is a frequency which is shifted in phase by 180° from an identical frequency. In a case where there are such identical frequencies with a phase difference of 180°, one of such frequencies adds algebraically to the other by the phase inversion, thereby cancelling or augmenting each other. The phase inversion in such a case therefore has much importance.

The fact that there are frequencies with a mutual phase difference of 180° in a modulated wave e is explained by "reflection of side frequencies."

The reflection of side frequencies occurs by existence of side frequencies in a negative domain below 0 Hz in the sideband spectrum. The side frequencies in the negative domain actually appear in the form in which they are reflected or folded into a positive domain. It will be noted that a negative angular frequency sin $(-\omega t)$ is $-\sin \omega t$ which is a signal obtained by inverting the sign of a frequency sin $\omega t$ in the positive domain. In this way, side frequencies in the negative domain are reflected into the positive domain by phase inversion. The reflected side frequencies are mixed with side frequency components in the positive domain. This mixing gives variety to the frequency relations in the modulated frequency signal e.

By way of demonstration, description will be made with reference to a case where the carrier frequency C is 100 Hz, the modulating frequency m 100 Hz and modulation index I=4.

Figure 3:
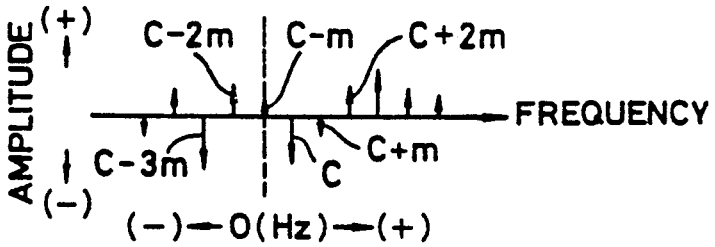
FIGS. 3(*a*) through 3(*c*) are graphical diagrams for explaining reflection of side frequencies.
Figure 3:
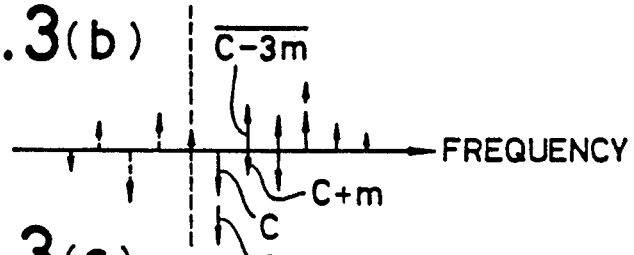
Figure 3:
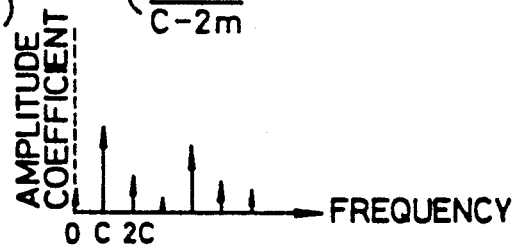

Since the frequency spectrum when I is 4 is as shown in FIG. 2, the frequency spectrum in this example assumes the form shown in FIG. 3(*a*). In the figure, the first lower-side frequency C−m is at 0 Hz and the second and the higher order of lower-side frequencies are in the negative frequency domain. These side frequencies C−2 m, C−3 m etc, are inverted in phase and reflected around 0 Hz into the positive domain. The reflected side frequencies algebraically add to side frequencies C, C+m C+2 m etc. in the positive domain. By this addition, amplitudes of frequencies of unlike signs are cancelled and those of frequencies of a like sign are augmented. Accordingly, absolute amplitudes of the spectrum in FIG. 3(*b*) are expressed in FIG. 3(*c*). FIG. 3(*c*) shows the frequency spectrum of the frequency modulated signal e consists of harmonics C, 2C, 3C etc. of the carrier C.

From the foregoing description, it will be understood that a signal containing harmonic components such as a musical tone can be produced by frequency modulation.

Spectral components of a musical tone signal (frequency modulated signal e) depend upon the ratio of the carrier C to the modulating frequencies m and the value of the modulation index I.

It is known that the frequency ratio C/m determines the position of the components in the spectrum while the modulation index which determines the bandwidth of the frequency modulated signal e determines the number of components which will have significant amplitudes. More specifically, a harmonic spectrum occurs when the frequency ratio C/m is a ratio of integers. If C/m in reduced to become $C/m=N_1/N_2$ and $N_1$ and $N_2$ are integers, a harmonic spectrum will occur. Since $N_1/N_2$ is an irreducible fraction, the fundamental frequency (first harmonic) $f_0$ of the frequency modulated signal wave e is expressed by an equation $$f_o=C/N_1=m/N_2.$$

It is also known that the position of the harmonic components in the harmonic spectrum can be determined from the following equation (3):

$$K=N_1\pm nN_2 \quad (3)$$

where n represents the order of the side frequencies and assumes values n=0, 1, 2, 3 . . . and K represents the harmonic number. The harmonic components in the harmonic spectrum are all of integer orders and, as will be apparent from the above equation (3), the carrier C always is a $N_1$-th harmonic. If $N_2=1$, the spectrum of the modulated signal wave e contains harmonics of all integer orders (as far as the modulation index I allows) and the modulating frequency m becomes the fundamental frequency $f_o$. If $N_2$ is an even number, the spectrum contains only odd number harmonics. If $N_2=3$, every third harmonic is missing from the spectrum.

Besides the above described harmonic spectrum, it is possible to obtain an inharmonic spectrum. The inharmonic spectrum occurs when the frequency ratio C/m is not a ratio of integers. If C/m is a ratio of non-integers, side frequencies in the negative domain are reflected to fall between side frequencies in the positive domain and the spectrum thereby becomes an inharmonic spectrum train. Inharmonic components contained in the inharmonic spectrum herein is referred to as harmonics of a non-integer order.

Regardless of harmonic or inharmonic spectrum, the fundamental frequency in the frequency modulated wave e is defined to be the lowest frequency component in the positive domain spectrum including components reflected from the negative domain. If the fundamental frequency is designated and then the frequency modulated wave e is obtained by frequency modulation, a musical tone signal of a predetermined pitch can be produced. According to the present invention, the fundamental frequency can be designated by manipulation on a keyboard.

As will be apparent from the foregoing description, the frequency ratio C/m varies by varying the carrier C or the modulating frequency m and, accordingly, the spectral components can be varied as desired. It is also possible to vary the amplitude of each of the spectral components and the harmonic number by varying the modulation index I. According to the present invention, a desired tone colour is produced by utilizing such characteristics and the tone colour is made to change with time.

It should be noted that the fundamental frequency is sometimes lost in the frequency modulated wave e depending upon the position of reflection of side frequencies in the negative domain or the value of the modulation index I. If, for example, a side frequency in the negative domain is reflected by phase inversion to the position of the fundamental wave with the same amplitude as the fundamental wave, or the modulation index I takes a value which makes the carrier amplitude $J_0$(FIG. 1) zero when the carrier C is the fundamental wave, the amplitude of the fundamental wave becomes 0 with a resultant disappearance of the fundamental wave. Besides these cases, the amplitude of the fundamental wave sometimes diminishes considerably in the harmonic spectrum. If the fundamental wave is missing from the frequency modulated wave e or the amplitude of the fundamental wave is extremely small, such frequency modulated wave cannot be used as a musical tone. Consideration must be given to overcome such inconvenience.

It is a feature of the present invention to ensure production of an accurate musical tone signal by superposing a special fundamental frequency upon the frequency modulated wave e. The basic equation of a musical tone signal E to be produced by the system according to the invention therefore is obtained by adding a fundamental component "a sin $\gamma$ t" to the previously described equation (1). The basic equation is:

$$E=a \sin \gamma t+A \sin (\alpha t+I \sin \beta t) \quad (4)$$

where a represents peak amplitude of the fundamental component and $\gamma$ angular frequency of the fundamental wave.

The general equation of frequency modulation shown as the equation (1) can be expanded to various formulas of frequency modulation.

Figure 4:
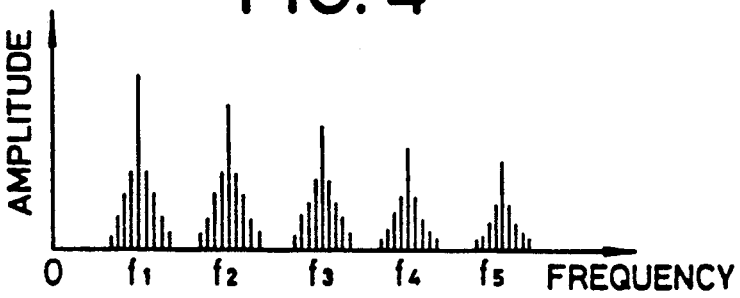
FIG. 4 is a graphical diagram showing an example of side frequency spectra occurring in a complicated frequency modulation.

If, for example, a carrier is modulated concurrently by two modulating waves, the frequency modulated wave $e_1$ is $$e_1=A \sin (\alpha t+I_1 \sin \beta_1 t+I_2 \sin \beta_2 t) \quad (5)$$

where $\beta_1$, $\beta_2$ represent angular frequencies of the respective modulating waves, $I_1$, $I_2$ modulation indexes and $\alpha$ angular frequency of the carrier. Evolution of the equation (5) reveals that the signal $e_1$ is composed of a number of complex side frequencies. The amplitudes of these side frequencies are determined by Bessel functions $J_0(I_1)$, $J_1(I_1)$ . . . $J_n(I_1)$, $J_0(I_2)$, $J_1(I_2)$ . . . $J_n(I_2)$ for the modulation indexes $I_1$, $I_2$. Assuming that the ratio of the carrier to the modulating waves is $\alpha$: $\beta_1$: $\beta_2$=1:0.1:1, the spectrum of the signal $e_1$ is shown in FIG. 4. The spectrum in the figure is a complex one with side frequencies appearing at an interval of $\beta_1$ on either side of each of harmonics $f_1$, $f_2$, $f_3$, $f_4$ . . . which are in harmonic relationship to each other. In this case, the magnitudes of the harmonics are determined by products of $J_0(I_1)$ and $J_0(I_2)-J_n(I_2)$ while the magnitudes of the side frequencies are determined by products of $J_0(I_1)-J_n(I_1)$ and $J_0(I_2)-J_n(I_2)$.

If a carrier is separately modulated by two modulating waves, the frequency modulated wave $e_2$ is $$e_2=A \sin (\alpha t+I_1 \sin \beta_1 t)+\sin (\alpha t+I_2 \sin \beta_2 t) \quad (6)$$

The signal $e_2$ obtained by the above equation (6) is equivalent to a signal obtained by superposing the two different signals e obtained by the equation (1).

If a carrier is composed of two different angular frequencies $\alpha_1$, $\alpha_2$ and modulated by a single modulating wave, the frequency modulated wave $e_3$ is $$e_3=A \sin (\alpha_1 t+\alpha_2 t+I \sin \beta t) \quad (7)$$

Musical tones can be produced by utilizing the complicated frequency modulation such as shown by the above equations (5) through (7).

DESCRIPTION OF PREFERRED EMBODIMENTS

Preferred embodiments of the invention will now be described with reference to FIG. 5 and subsequent figures.

Figure 5:
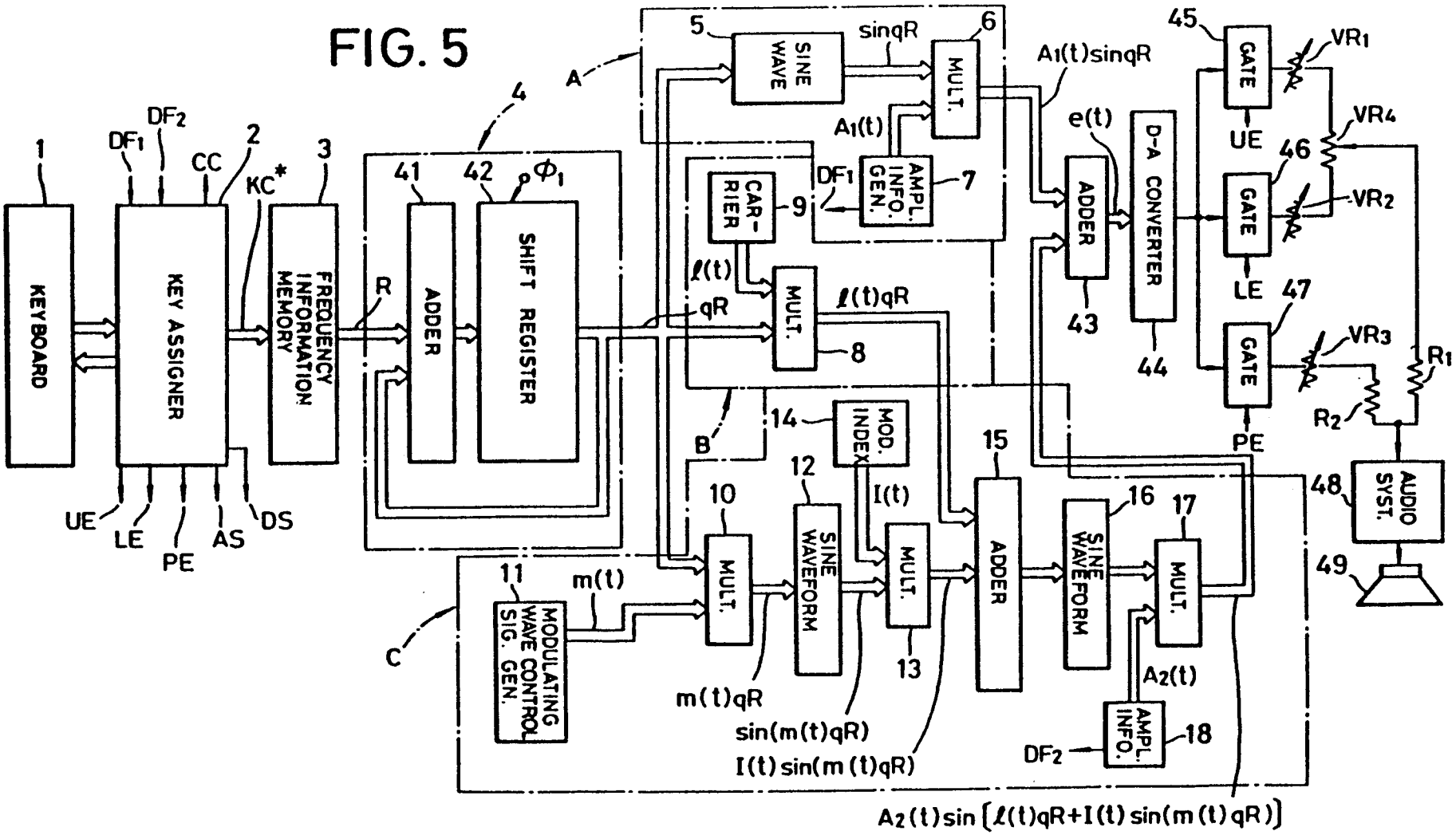
FIG. 5 is a block diagram showing an embodiment of the electronic musical instrument according to the invention.

Referring first to FIG. 5, a musical tone signal e can be obtained by the example shown in FIG. 5 in accordance with the following equation:

$$e(t)=A_1(t) \sin qR+A_2(t) \sin [l(t)qR+I(t) \sin (m(t)qR)] \quad (8)$$

The equation (8) is substantially equivalent to the previously described equation (4) except that the amplitude, carrier wave, modulating wave and modulating index evolve as functions of time in the equation (8). In the equation (8), the value qR represents the phase $\gamma$ t of the fundamental wave and successively increases according to the integral increase of the value q thereby exhibiting time lapse, and the value $A_1(t)$ represents a peak amplitude of a specially provided fundamental component sin qR in the form of a function of time. The phase $\alpha$ t of the carrier is given by the value l(t) qR which is obtained by multiplying the phase qR of the fundamental wave by the time function l(t). The phase $\beta$ t of the modulating wave is given by the value m(t) qR which is obtained by multiplying the phase qR of the fundamental wave by the time function m(t). The modulation index I assumes a form of a time function I(t) so that it will vary with time. The value $A_2(t)$ represents a peak amplitude of the modulated signal portion in the form of a function of time.

The value R is a numerical value relating to the fundamental frequency of a musical tone to be produced and is in proportion to the phase of the fundamental frequency in a certain sample period of the waveform amplitude. The value q increases 1, 2, 3 . . . as the sample point proceeds and, assuming that the number of sample points of the waveform is n, returns to 1 after the sample point exceeds n, repeating the variation 1, 2, 3 . . . and thereby causing the phase to proceed.

TIME DIVISION KEY ASSIGNMENT OPERATION FOR REPRODUCTION OF PLURAL TONES

The computation according to the above equation (8) is implemented in a time-shared manner with respect to a plurality of tones.

A keyboard 1 has three kinds of keyboards, i.e. upper keyboard, lower keyboard and pedal keyboard and key switches are provided for respective keys of these keyboards.

Figure 6:
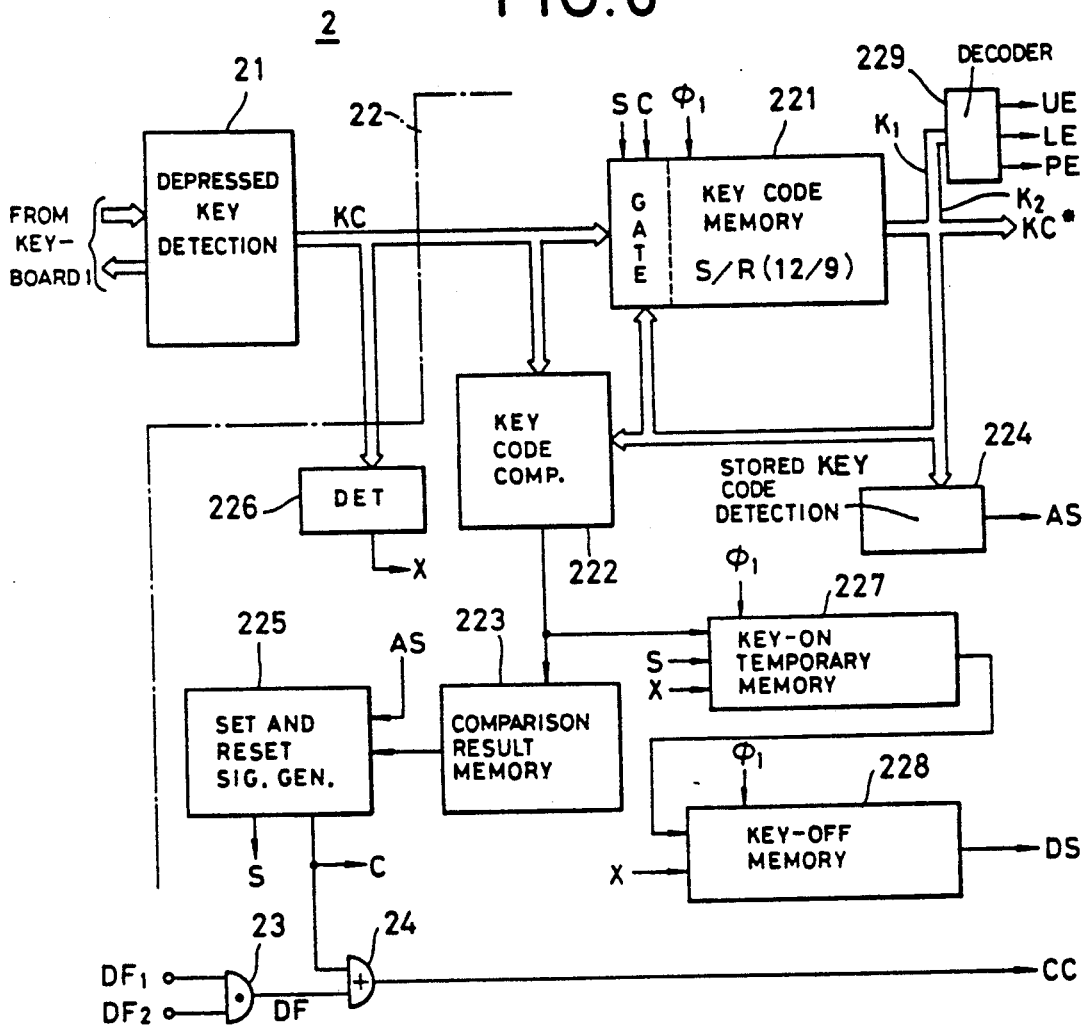
FIG. 6 is a block diagram showing an example of a key assigner used in the embodiment shown in FIG. 5.

A key assigner 2 comprises, as schematically shown in FIG. 6, a depressed key detection circuit 21 provided for detecting ON-OFF operations of the respective key switches and an assignment circuit 22 provided for assigning, in response to the result of detection in the circuit 21, information concerning a depressed key to one of channels provided in number of a maximum number of tones to be reproduced simultaneously. Information of each depressed key delivered sequentially from the depressed key detection circuit 21 is represented, for example, by a code signal (i.e. key code KC) composed of a plurality of bits and indicating the depressed key in an encoded fashion. Each code signal therefore has different contents from others. The assigning circuit 22 comprises a key code memory circuit 221 having a number of memory circuits corresponding to the respective channels. If a key code KC from the depressed key detection circuit 21 is stored in one of these memory circuits, this signifies that the key code has been assigned to the channel defined by the particular memory circuit. Conditions for this key assigning operation are kenown to be:

(A) The key code should be assigned to a memory circuit in which there is no storage of any key code (i.e. an empty channel); and (B) The same key code should not be redundantly stored in plural memory circuits.

The key code memory circuit 221 should preferably be constructed of a circulating type shift register including a gate on the input side thereof. Assuming, for example, that a total number of channels is 12 and that the key code KC consists of 9 bits, a shift register of 12 stages (one stage is made of 9 bits) is employed and a stored (i.e. already assigned) key code KC* is fed back to the input side of the shift register. Contents of the shift register are sequentially shifted in accordance with a master clock pulse $\phi_1$. As the contents of the shift register are shifted, the stored key codes KC* for the respective channels delivered out in a time shared manner from the final stage of the shift register are used for generation of musical tones as address data for accessing a frequency information memory 3 to be described later.

Figure 7:
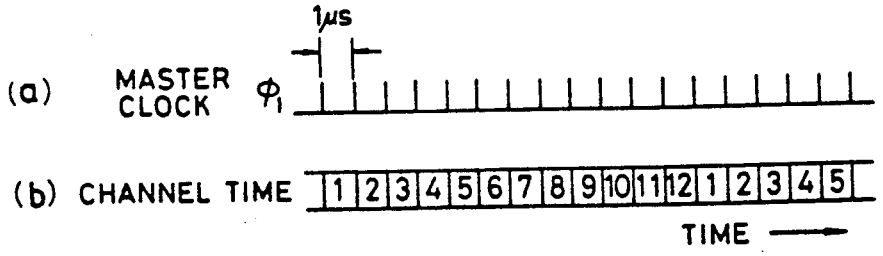
FIGS. 7(*a*) and 7(*b*) are graphical diagrams showing timing relations between the master clock and respective channel time used in the above embodiment.

The master clock pulse $\phi_1$ is generated at a suitable interval, e.g. 1 $\mu$s as shown in FIG. 7(*a*). Time slots each of which has a width of 1 $\mu$s are formed by the master clock $\phi_1$ and used one after another for processing data of the first through the twelfth channels. Each of these time slots is referred to as "channel time". Accordingly, channel times for the first through the twelfth channels circulate one after another. Components of the system according to the invention are therefore constructed on the basis of dynamic logic so that they will operate in synchronization with the respective channel times. The stored key codes KC* for the respective channels are outputted in synchronization with these channel times.

In the assigning circuit 22, a key code comparison circuit 222 compares contents of an input key code KC and those of a stored key code KC* and produces a signal representing a result of comparison, i.e. whether there is coincidence or not. By virtue of this comparison, whether the above described condition (B) has been satisfied or not is known. The input key code KC from the depressed key detection circuit 21 is continuously supplied while the stored key codes KC* for a time period in which all of the channels circulate twice. The above described comparison is made during the first circulating period. The result of the comparison is stored in a comparison result memory circuit 223 and delivered out of this circuit 223 during the second circulating period.

Presence or absence of the condition (A) for the key assignment can be known by detecting presence or absence of the stored key code KC* by a stored key code detection circuit 224. The detection circuit 224 produces a signal "1" at a channel time during which the stored key code KC* is present and a signal "0" at a channel time during which the stored key code KC* is absent (i.e. at a channel time representing an empty channel). The output signal "1" of the detection circuit 224 is utilized for controlling a musical tone as an attack start signal AS which represents depression of a specific key (i.e. representing that a key code has been stored in the channel corresponding to the specific key and the key assignment has been made). The output signal of the detection circuit 224 is also utilized for detecting presence or absence of the condition (A).

A set and reset signals generation circuit 225 is provided for identifying whether the above conditions (A) and (B) are both satisfied or not on the basis of the outputs of the comparison result memory circuit and the stored key code detection circuit 224 and, when the two conditions have been satisfied, produces a set signal S and a reset signal C at a channel time at which a new key code KC should be assigned. The set signal S and the reset signal C are applied to the gate of the key code memory circuit 221 for controlling the gate in such a manner that the feedback input side of the circuit 221 will be reset and the new input key code KC will be simultaneously stored in the first stage thereof. Thus, the key code KC is stored in the channel corresponding to the channel time.

For detection of release of the depressed key, a start code representing start of detection of the release of the key (different from the key codes representing the respective key switches) is regularly produced from the depressed key detection circuit 21 during production of the key code KC. A detection circuit 226 detects the supply of this start code and thereupon generates a compulsory reset signal X.

A key-on temporary memory circuit 227 comprises a number of stages corresponding to the respective channels and, when the set signal S is produced for causing the key code KC to be stored in a certain channel, memoriezes a signal "1" in one of the stages corresponding to the channel. This storage of signal "1" is compulsorily reset by the compulsory reset signal X. When the same key code KC is provided, a coincidence detection signal is supplied from the key code comparison circuit 222 so that a signal "1" is stored again in the same channel.

A key-off memory circuit 228 also has stages corresponding to the respective channels. This circuit 228 detects, upon generation of the compulsory reset signal X, a channel of the key-on temporary memory circuit 227 in which a signal "1" is not stored and, judging that the input of the key code KC assigned to the channel has already been reset, i.e. the depressed key represented by that key code has already been released, causes a signal "1" to be stored in the stage of the key-off memory circuit 228 corresponding to the channel. This signal DS representing release of the key is utilized for controlling a musical tone as a decay start signal as will be described later.

The amplitude of the musical tone signal e to be obtained by the equation (8) is determined by amplitude values A(t) and $A_2(t)$. Decay finish signal $DF_1$ and $DF_2$ which respectively represent that the values $A_1(t)$ and $A_2(t)$ have turned "0" are respectively produced by amplitude information generation circuits 7 and 18. The fact that both amplitude values $A_1(t)$ and $A_2(t)$ have become "0" signifies the finish of reproduction of the musical tone (e). Accordingly, the fact that the decay finish signals $DF_1$ and $DF_2$ have become "0" is detected by an AND gate 23 whereby termination of reproduction of the musical tone is known. The output signal "1" of the AND gate 23 is applied to an OR gate 24 as a reproduction finish signal (all decay finish signal) DF. The reset signal C also is applied to the OR gate 24. The output of the OR gate 24 is utilized for resetting various counters and memories as a counter clear signal CC.

In the present embodiment, the keyboard 1 is constructed of three kinds of keyboards as was previously described. Assuming that the key code KC (or KC*) is a code signal of 9 bits, 16 different combinations available from a 4-bit code portion thereof are allotted to represent 12 notes C, C#, D, . . . A# and B, 8 different combinations available from a 3-bit code portion thereof are allotted to represent octave ranges within a single keyboard and 4 different combinations available from a 2-bit code portion thereof are allotted to represent the three kinds of keyboards. The 2-bit code $K_1$, $K_2$ representing the kind of keyboard in the stored key code KC* is applied to a decoder 229 to-detect the keyboard to which the key specified by the key code KC* belongs. If the detected keyboard is the upper keyboard, an upper keyboard signal UE is produced. Likewise, if the lower keyboard is detected, a lower keyboard signal LE is produced and if the pedal keyboard is detected, a pedal keyboard signal PE is produced. The keyboard signals UE, LE and PE are utilized for controlling musical tones keyboard by keyboard.

All signals coming in and going out of the assigning circuit 22 (signals KC*, AS, DS, CC, $DF_1$, $DF_2$ and so forth excluding the input key code KC) are generated in a time shared manner in synchronization with the respective channel times.

The construction of the key assigner 2 is not limited to the one shown in FIG. 6 but any construction that is capable of assigning information of a depressed key to a related channel may be employed. For example, one may use the key assigner disclosed in U.S. Pat. No. 3,882,751.

GENERATION OF PHASE INFORMATION qR

The key codes KC* assigned to the respective channels are provided in time-sharing by the key code memory 221 of the key assigner 2 and sequentially supplied to a frequency information memory 3. The frequency information memory 3 previously stores the value R of the above equation (8) corresponding to the note frequencies of the keys represented by the key codes KC* (hereinafter referred to as frequency information) at addresses corresponding to the key codes. When a certain key code is applied to the frequency information memory 3, frequency information R stored at an address designated by the key code is read out.

The frequency information R is binary data of a suitable number of bits, e.g. 15 bits, a 14-bit portion thereof including the least significant bit through the fourteenth bit representing a value of a fractional section and one-bit portion of the fifteenth bit representing a value of an integer section.

The frequency information R read sequentially and in a time shared manner from the frequency information memory 3 is applied to a circulating type counter 4 of 12 stages (1 stage=21 bits) and cumulatively counted therein at a regular interval (e.g. every 12 channel times). In the counter 4, 7-bit data from the fifteenth bit to the twenty-first bit (the most significant bit) is treated as data representing an integer section. The counter 4 consists of an adder 41 of 21 bits and a 12-stage/21-bit shift register 42. The contents of the counter 4 are shifted by the master clock $\phi_1$ and data produced from the final stage of the shift register 42 when 12 channel times have elapsed is fed back to the adder 41 in which it is added to the output R of the frequency information memory 3. Accordingly, the value R increases at every 12 channel times to 2R, 3R, 4R . . . (=qR). Thus, phase information qR of tones assigned to the respective channels is produced in time-sharing from the counter 4 synchronously with the respective channel times.

If 12 channel times are equivalent to 12 μs as in the present embodiment, the number of times the value R is cumulatively added per second is $1/12\times10^6$. Accordingly, the number q which increases as the phase of one waveform of the fundamental wave proceeds is $$q = \frac{10^6}{12} \times \frac{1}{f}$$

where f represents the fundamental frequency.

Assuming that one waveform of a sine wave for forming the fundamental waveform sin qR is stored at 64 sample points in a sine waveform memory 5, the phase information qR upon completion of reading from the final address is qR=64. The value of the frequency information R (in decimal notation) is $R=12\times64\times f\times10^{-6}$. The frequency information R given by this equation is stored as binary data corresponding to the respective key codes in the frequency information memory 3.

GENERATION OF MUSICAL TONE

The phase information qR provided by the counter 4 is supplied to three processing systems A, B and C. The processing systems A, B and C consist of circuits for implementing calculation of right terms of the equation (8). The system A calculates the term $A_1(t)$ sin qR for the fundamental component, while the system B and C calculate the terms "$A_2(t)$ sin [I(t) qR+I(t) sin (m(t)qR)]" for frequency modulation.

Accordingly, the phase information qR is utilized as a signal corresponding to the phase of a musical tone signal in the system A while it is utilized as basic data for introducing phase elements of the carrier and modulating wave in the frequency modulation equation. The phase information qR can produce a sufficient effect by utilizing only an integer section thereof consisting of 7 bits counting from the most significant bit in the systems A, B and C.

Calculation of the fundamental component will first be described. The sine wave waveform meory 5 constructed of a suitable memory device, e.g. a read-only memory stores amplitude values obtained by sampling a waveform for one cycle of sine wave by a suitable sampling number, e.g. 64, at corresponding addresses. The memory 5 receives the phase information qR as its address input and thereupon produces an instantaneous amplitude value of the corresponding address. Thus, amplitude values corresponding to the phases at respective time points are delivered out in real time whereby a sine wave sin qR is produced from the memory 5.

This sine wave signal (e.g. the fundamental wave signal) sin qR is applied to a multiplier 6. The multiplier 6 receives also the peak amplitude information $A_1(t)$ of the fundamental wave and a result of the multiplication $A_1(t)$ sin qR is produced from the multiplier 6. Such calculation of the fundamental wave component is carried out in a time-shared fashion for each of the channels.

The peak amplitude information $A_1(t)$ is produced from an amplitude information generation circuit 7 channel by channel in synchronization with the corresponding channel time. The amplitude information $A_1(t)$ changes with time and constitutes an envelope shape rising upon depression of the key and attenuating after release of the key. Any circuit known as an envelope generator can be employed as the amplitude information generation circuit 7.

Figure 9:
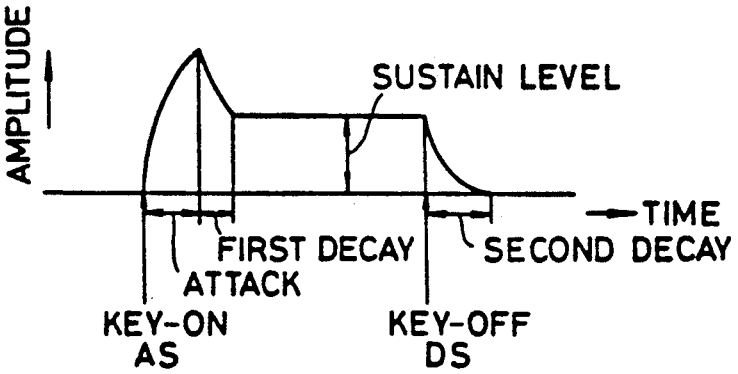
FIG. 9 is a graphical diagram showing a typical envelope of amplitude information generated by the amplitude information generation circuit shown in FIG. 8.
Figure 8:
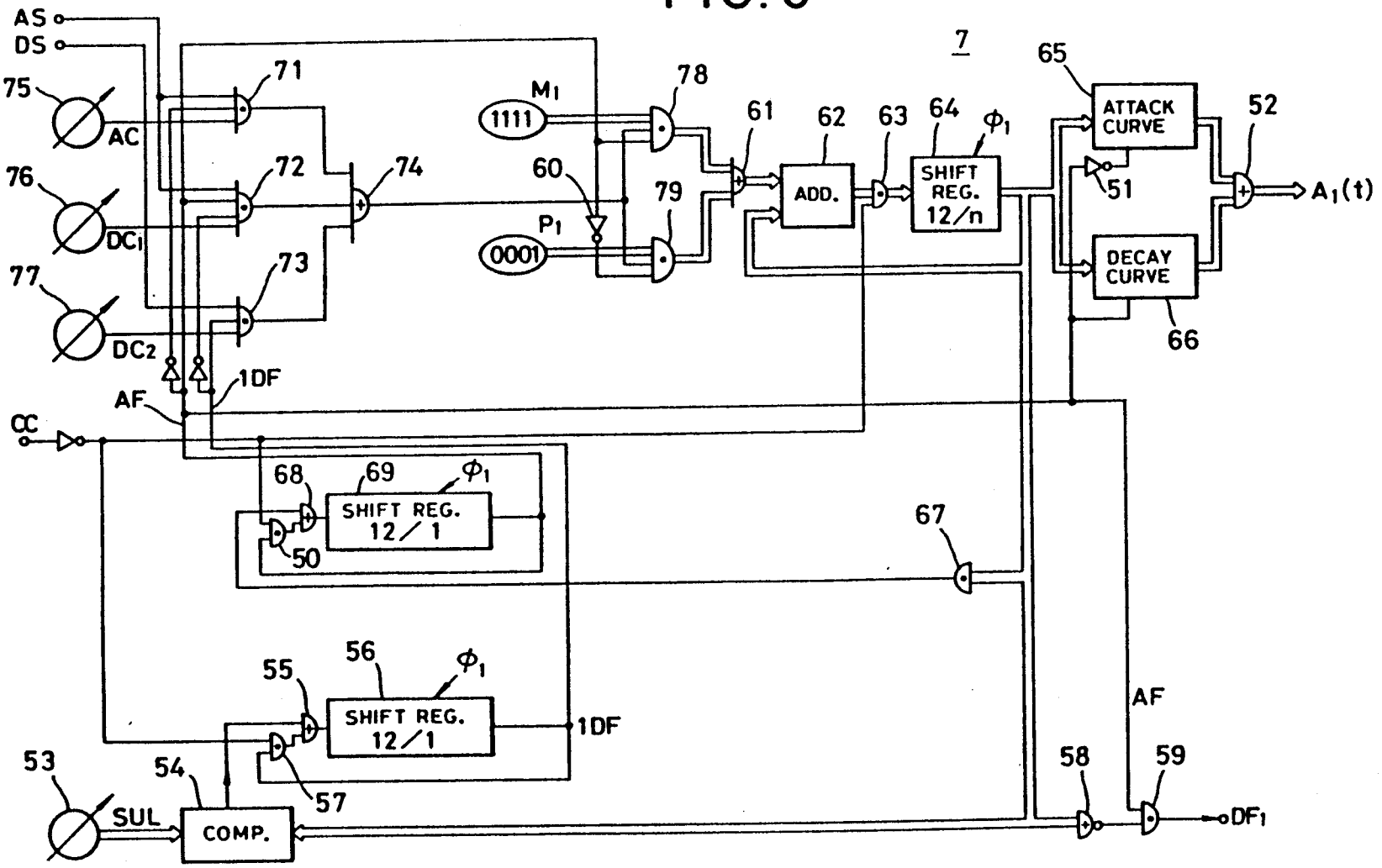
FIG. 8 is a block diagram showing an example of an amplitude information generation circuit used in the above embodiment.

FIG. 8 shows an example of the amplitude information generation circuit 7. The circuit 7 operates in response to the attack start signal AS and the decay start signal DS, generating digitally an envelope of the amplitude information $A_1(t)$ as shown in FIG. 9. As the attack start signal AS is applied to an AND gate 71, an attack clock pulse AC is applied to the AND gate 79 through the AND gate 71 and an OR gate 74. Since a signal "1" has already been applied to the AND gate 79 via an inverter 60, "1" adding data $P_1$ is selected and provided by the AND gate 79 in synchronization with the attack clock AC. The "1" adding data $P_1$ is data of n bits of which the least significant bit (first bit) is "1" and the reset of the bits (second to n-th bits) are all "0". The "1" adding data $P_1$ produced from the AND gate 79 is applied to an adder 62 of n bits through an OR gate 61. The output signal of the adder 62 is applied to a 12-stage/n-bits shift register 64 via an AND gate 63. The signal is delayed in the shift register 64 by 12 channel times in accordance with the clock $\phi_1$ and thereafter is delivered out of the shift register 64. The output of the shift register 64 is fed back to the adder 62 and added to the data supplied from the OR gate 61. Accordingly, data of the particular channel contained in the shift register 64 increases one by one in accordance with the attack clock AC.

The output of the shift register 64 is supplied to an attack curve memory 65 and a decay curve memory 66 to be used as address signals for reading out the attack curve and the decay curve stored in these memories. During the attack mode, the attack curve memory 65 only is available for reading, the decay curve memory 66 staying inoperative. Accordingly, as the output of the register 64 gradually increases during the channel time, an attack curve as shown in FIG. 9 is successively read out.

When all of the n-bit outputs of the shift register 64 have become "1", a peak value of the attack curve has been read out and this peak value is detected by an AND gate 57. When the reading of the attack curve has been completed, the AND gate 67 produces m output "1" which in turn is stored in a 12-stage/1-bit shift register 69. The signal "1" stored in the shift register 69 is delivered out at a time slot of the particular channel after 12 channel times and is self-held in the shift register 69 via an AND gate 50. The output of the shift register 69 is a signal AF which represents finishing of the attack. When this signal AF is turned to "1", the AND gate 71 is inhibited and an AND gate 72 is enabled. Since the attack finish signal AF is also applied to the inverter 60, the AND gate group 79 is inhibited by an output "0" of the inverter 60. Now an AND gate group 78 to which the signal AF is applied is enabled and a first decay clock $DC_1$ generated by a first decay clock oscillator 76 is supplied through the AND gate 72 and the OR gate 74 to the AND gate group 78 to control the gate of the AND gate group 78 for selecting "1" subtracting data $M_1$ in synchronization with the first decay clock $DC_1$. The "1" subtracting data $M_1$ is applied to the adder 62 via the OR gate 61. The "1" subtracting data $M_1$ is data of n bits and all bits thereof are "1". Accordingly, by adding the "1" subtracting data $M_1$ to the contents of the particular channel of the shift register 64 which has contained the peak value (i.e. all of the n bits are "1"), the contents of the shift register 64 are subtracted one by one in sychronization with the first decay clock $DC_1$. In other words, all carry data above the n-th bit overflows whereby subtraction is substantially carried out.

When the attack finish signal AF has become "1", the output of the inverter 51 becomes "0" so that the attack curve memory 65 is disabled whereas the decay curve memory 66 is enabled. Thus, a decay curve as shown in FIG. 9 is read from the decay curve memory 66 in accordance with gradually decreasing address data provided by the shift register 64. The outputs of the attack curve memory 65 and the decay curve memory 66 are combined in the OR gate group 52 and thereafter are supplied to the multiplier 6. Consequently, amplitude information $A_1(t)$ continuing from the attack state to the first decay state as shown in FIG. 9 is obtained.

A sustain level SUL shown in FIG. 9 is produced by the sustain level setter 53 at a value corresponding to the address of said level SUL. Coincidence of the level SUL set by the sustain level setter 53 with the output of the shift register 64 (the address of the memory 66) is detected by a comparator 54 and a coincidence detection output "1" is stored in a 12-stage/1-bit shift register 56 via an OR gate 55. The output of the shift register 56 is applied to an AND gate 73 as a first decay finish signal 1DF. The output of the register 56 also inhibits the AND gate 72 and is held in the register 56 via the AND gate 57. Application of the first decay clock $DC_1$ is stopped by the signal 1DF and the count of the particular channel in the shift register 64 is held at a constant value. Accordingly, the output read from the decay curve memory is also made constant with a result that the sustain level SUL is maintained until the release of the key as shown in FIG. 9.

When the key has been released, the decay start signal DS is provided by the key assigner 2 enabling the AND gate 73. A second decay clock $DC_2$ generated by a second decay clock oscillator 77 is now applied to the AND gate group 78 via the AND gate 73 and the OR gate 74. Accordingly the "1" subtracting data $M_1$ is applied to the adder 62 in synchronization with the second decay clock $DC_2$, starting subtraction from the contents held in the shift register 64. Thus, the address for accessing the memory 66 which has been temporarily suspended at the sustain level SUL is further advanced and a decay curve of the second decay portion shown in FIG. 9 is read out.

As the subtraction proceeds and the contents held in the particular channel of the shift register 64 become "0", the reading of the decay curve is completed. Completion of the decay is detected when a NOR circuit 58 has detected that all of the n-bits of the output from the shift register 64 have become "0". The output signal "1" of the NOR circuit 58 is delivered through the AND gate 59 which receives attack finish signal AF at one of its inputs. This signal "1" is used as the decay finish signal $DF_1$. The above arrangement is made because the decay finish signal $DF_1$ should be generated only after the attack finish signal AF has been generated. The decay finish signal $DF_1$ is supplied to the AND gate 23 of the key assigner 2. When the counter clear signal CC is supplied from the key assigner 2, contents stored in the particular channel of the shift registers 64, 69 and 56 are reset to "0".

In the above described manner, a digital envelope shape as shown in FIG. 9 is applied to the multiplier 6 as the time-variant amplitude information $A_1(t)$. Mode of variation of the amplitude information $A_1(t)$ can be determined as desired by suitably changing clocks oscillated from the respective oscillators 75–77 or setting of sustain level setter 53. Since the adder 62 and the shift register 64 are shared in use by the respective channels in a time shared fashion, the amplitude information $A_1(t)$ is generated in time-sharing for each of the channels.

Computation of the frequency modulation section will now be described.

In the processing system (B), the phase information qR is applied to a multiplier 8. In the multiplier 8, the time-variant coefficient information l(t) is multiplied with the phase-information qR to obtain phase information l(t) qR of the carrier component. The coefficient information l(t) is generated by a carrier control signal generation circuit 9. The carrier frequency can be varied by suitably selecting this coefficient information l(t).

In the processing system C, the phase information qR is applied to a multiplier 10. In the multiplier 10, time-variant coefficient information m(t) is multiplied with the phase information qR to obtain phase information m(t)qR of the modulating wave component. The coefficient information m(t) is generated by a modulating wave control signal generation circuit 11. The modulating wave frequency can be suitably varied by this coefficient information m(t). The phase information m(t)qR provided by the multiplier 10 is applied to a sine waveform memory 12 to read out an amplitude value at a sine waveform sample point corresponding to the phase value m(t)qR. The memory 12 is of a similar construction to the sine waveform memory 5. The modulating wave signal sin (m(t)qR) read from the sine waveform memory 12 is applied to a multiplier 13 in which it is multiplied with the modulation index information I(t). The modulation index I(t) which is adapted to vary with time is generated by a modulation index control signal generation circuit 14.

The output I(t) sin(m(t)qR) of the multiplier 13 is applied to an adder 15 and added to the value l(t)qR supplied from the multiplier 8. Accordingly, the adder 15 produces a value l(t)qR+I(t) sin(m(t)qR) which determines the phase of the entire wave of frequency modulated wave. This output of the adder 15 is applied to a sine waveform memory 6 for reading instantaneous amplitude values at respective sample points of a sine waveform stored therein. The memory 16 is of a similar construction to the sine waveform memories 5 and 12.

The modulated signal wave sin [l(t)qR+I(t) sin (m(t)qR)] produced from the sine waveform memory 16 is applied to a multiplier 17 and multiplied with peak amplitude information $A_2(t)$ of the frequency modulated wave component. The peak amplitude information $A_2(t)$ is generated by an amplitude information generation circuit 18. This circuit 18 may be constructed in the same manner as the amplitude information generation circuit 7 shown in FIG. 8. An envelope shape corresponding to the depression and release of the key as shown in FIG. 9 is supplied to the multiplier 17 as the amplitude information $A_2(t)$.

Accordingly, the envelope shapes of the fundamental wave component and the frequency modulated wave component are separately and individually controlled in accordance with the amplitude information $A_1(t)$ and $A_2(t)$. As a result of the multiplication, the modulated signal wave controlled in its amplitude $A_2(t)$ sin [l(t)qR+I(t) sin m(t)qR] is provided by the multiplier 17.

As was described above, the frequency ratio C/m between the carrier and the modulating wave determines the positions of the harmonics and the modulation index I determines the number of the harmonics. The positions of the harmonics therefore are determined by the coefficient information l(t) and m(t) and the number of the harmonics varies in accordance with the value of the modulation index information I(t). Accordingly, by suitably setting and varying the respective information l(t), m(t), and I(t), a desired tone colour can be produced and a complicated temporal evolution of the tone colour can be readily simulated.

The signal generation circuits 9, 11 and 14 for generating the respective information l(t), m(t) and I(t) are constructed so that values and temporal evolutions thereof of the respective information (t), m(t) and I(t) can be programmed as desired for producing a desired tone colour and tone colour change. This programming can be made simply by operation elements such as switches without employing a complicated soft ware.

Figure 10:
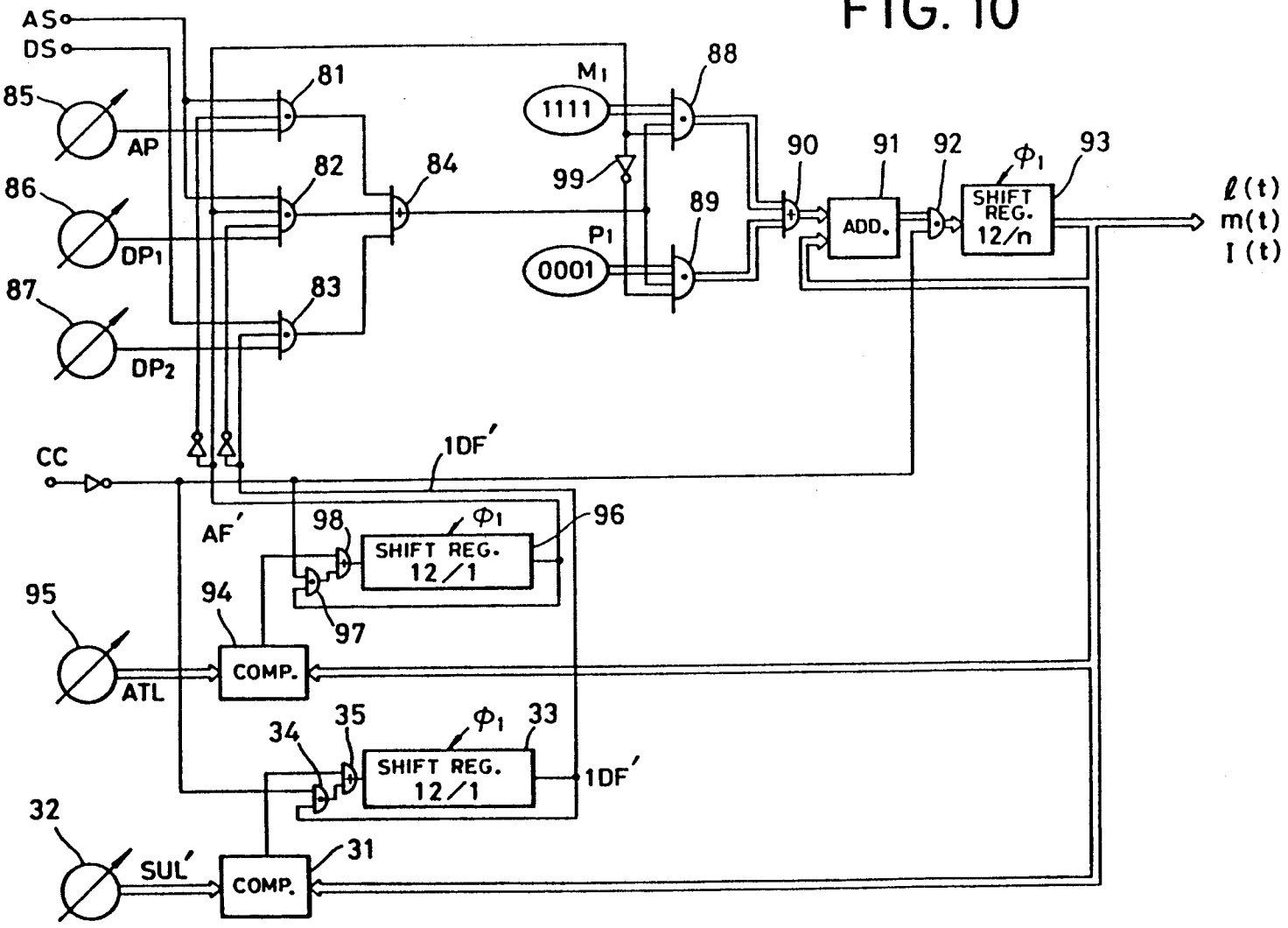
FIG. 10 is a block diagram showing examples of various control signal generation circuits used in the same embodiment.

FIG. 10 shows an example of the carrier control signal generation circuit 9 or the modulating wave control signal generation circuit 11 or the modulation index control signal generation circuit 14. The signal generation circuit shown in FIG. 10 is a construction similar to the amplitude information generation circuit 7 of FIG. 8, so that the detailed description concerning FIG. 8 will be useful for understanding of the example shown in FIG. 10. As the attack start signal AS is supplied from the key assigner 2, the attack clock pulse AP enables and AND gate group 89 via and AND gate 81 and an OR gate 84. "1" adding data $P_1$ of n bits is produced from the AND gate group 89 in synchronization with the attack clock AP and applied to an adder 91 of n bits via an OR gate group 90. A counter is composed of the adder 91, AND gate group 92 and a circulating shift register 93 of a 12-stage/n-bit construction. This counter is shared by the 12 channels in a time shared fashion. Thus, "1" is successively added in accordance with the attack clock AP and the result of the cumulative addition is accumulated in a shift register 93. The output of the shift register 93 is supplied from the generation circuit 9, 11 or 14 to the multiplier 8, 10 or 13 as the coefficient information l(t) or m(t), or the modulation index information I(t). Accordingly, the information l(t), m(t) and I(t), i.e. the output of the shift register 93, typically are gradually increasing values in the attack portion starting from depression of the key.

Figure 11:
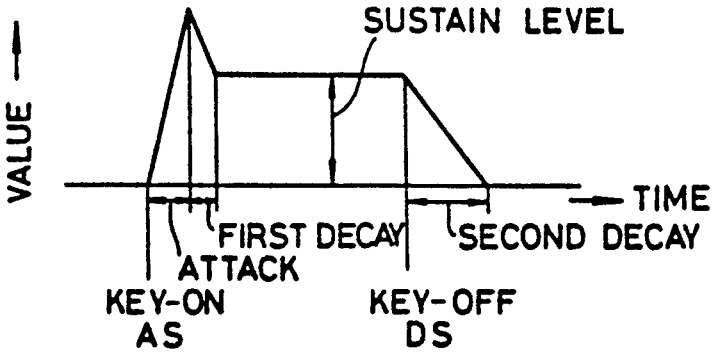
FIG. 11 is a graphical diagram showing a typical envelope of the control signals generated by the circuits shown in FIG. 10.

The output of the shift register 93 is applied to a comparator 94 and compared with an attack level ATT which has previously been set by an attack level setter 93. When there is coincidence, the output of the comparator 94 is a signal "1". This signal "1" is stored in a 12-stage/1-bit circulating shift register 96 and held therein via an AND gate 97 and an OR gate 98. The output of the shift register 96 enables the AND gate 82 as an attack finish signal AF' while it inhibits the AND gate 81. The attack finish signal AF' also diseanables the AND gate group 89 via an inverter 99 while it enables the AND gate group 88. Accordingly, the AND gate group 88 is enabled in synchronization with the first decay clock pulse $DP_1$ from the variable clock oscillator 86 causing "1" subtracting data $M_1$ consisting of n bits which are all "1" to be applied to the adder 91. The stored cumulative value of the particular channel of the shift register 93 is subtracted one by one in response to the "1" subtracting data $M_1$ so that the information l(t), m(t) and I(t) decrease as shown by a first decay portion in FIG. 11.

The output of the shift register 93 is applied to a comparator 31 where it is compared with a sustain level SUL' which has previously been set by a sustain level setter 32. When there is coincidence, a signal "1" is stored in the particular channel of a 12-stage/1-bit circulating shift register 33 and held therein via an AND gate 34 and an OR gate 35. The output of the shift register 33 is applied to the AND gate 83 as a first decay finish signal DF' while it inhibits the AND gate 82. This temporarily suspends application of the clock and causes the output of the shift register 93 (the information l(t), m(t) and I(t)) to maintain the constant sustain level SUL:

When the decay start signal DS is provided by the key assigner 2, the AND gate 83 is enabled to pass the second decay clock $DP_2$ from the variable clock oscillator 87 to the AND gate group 88. Accordingly, the stored cumulative value of the shift register 93 is subtracted one by one in response to the second decay clock $DP_2$ to produce information l(t), m(t) and I(t) as shown in a second decay portion in FIG. 11. When sounding of the tone of the particular channel has been completed and the counter clear signal CC has been generated, the contents of the channel in the registers 93, 96 and 33 are cleared.

Since the respective clocks AP, $DP_1$ and $DP_2$ and the levels ATL and SUL' can be individually varied in the signal generation circuits 9, 11 and 14, the respective information l(t), m(t) and I(t) can be programmed as desired. At the sustain level SUL' a constant value is maintained and, accordingly, the carrier, the modulating wave and the modulationg index remain constant without any variation. A constant tone colour therefore is reproduced during the sustain level SUL'. On the other hand, the tone colour changes in complicated manner during the attack or decay mode. Thus, a tone colour effect which is a close simulation of a complicated variation of harmonic components of a natural musical tone during the attack and decay modes is produced.

The construction of the signal generation circuits 9, 11 and 14 are not limited to the examples shown in FIG. 10 but they may be constructed in such a manner that variations of the information l(t), m(t) and I(t) are previously stored in memories and they are read out upon depression and release of the keys for simulating the temporal variations of the frequency spectra of various natural musical instrument tones.

The fundamental wave component signal $A_1(t)$ sin qR and the frequency modulated wave signal $A_2(t)$ sin [l(t) qR+l(t) sin(m(t)qR)] are applied to an adder 43 and added together. All computation in the respective processing systems A, B and C is digitally made and implemented for the respective channel times in a time shared fashion. Accordingly, the adder 43 produces a digital signal representing the waveform amplitude value of the musical tone signal e(t) at a given time. This digital signal is applied to a digital-to-analog converter 44 for converting it to an analog amplitude value. Thus, the digital-to-analog converter 44 provides in time-sharing analog musical tone signals e(t) assigned to the respective channels and these signals e(t) are supplied to analog gate circuits 45, 46 and 47 so that they are distributed to the respective keyboard lines.

The decoder 229 of the key assigner 2 (FIG. 6) produces signals UE, LE and PE which respectively identify the keyboard kind to which a tone assigned to the respective channels belongs in synchronization with the given channel time. The upper keyboard signal UE is applied to the gate circuit 45 and the gate circuit 45 is enabled at a channel time to which the upper keyboard tone is assigned for passing the musical tone signal e(t) from the converter 44. Similarly, the lower keyboard signal LE is applied to the gate circuit 46 for passing only the musical tone signal e(t) from the converter 44. The pedal keyboard signal PE is applied to the gate circuit 47 for passing the musical tone signal of the pedal keyboard.

The musical tone signals provided by the gate circuits 45–47 are individually controlled in their volume by variable resistors $VR_1$, $VR_2$, and $VR_3$. Thereafter, the upper keyboard tone and lower keyboard tone are controlled for ballancing in their volume and then mixed with the pedal keyboard tone. The musical tone signal which has thus been controlled in volume keyboard by keyboard is reproduced from a speaker 49 through an audio system 48.

Figure 12:
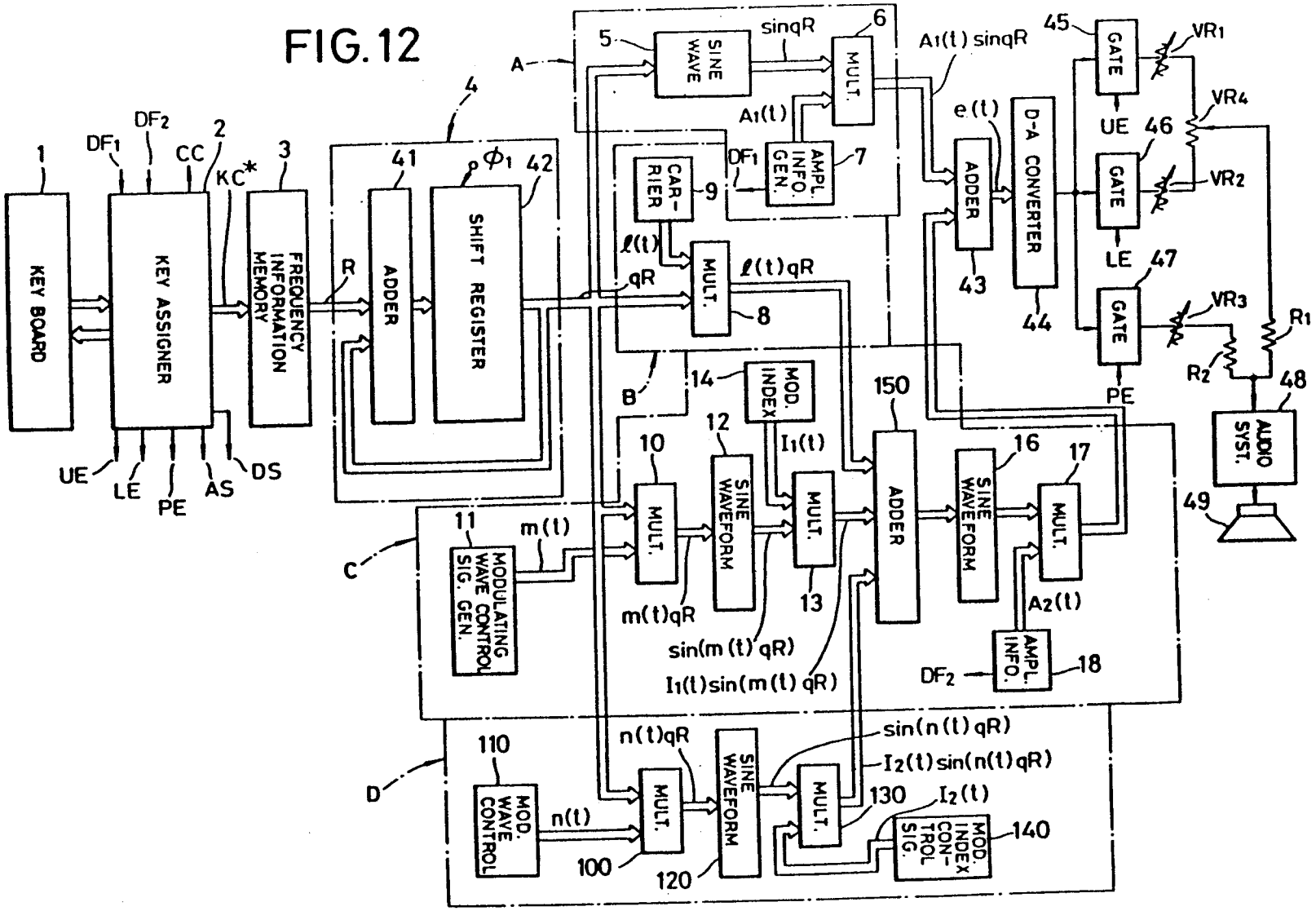
FIG. 12 is a block diagram showing another embodiment of the invention.

FIG. 12 is a block diagram showing another embodiment of the electronic musical instrument according to the invention. The device shown in FIG. 5 is constructed on the basis of the basic frequency modulation system represented by the equation (1). If an electronic musical instrument is constructed by employing a complicated frequency modulation system such as represented by the above described equation (5) or (7), a more complicated tone colour variation than the one obtained by the example of FIG. 5 will be obtained.

In the electronic musical instrument shown in FIG. 12, a musical tone signal is generated by utilizing the frequency modulation system according to the equation (5). In this embodiment, the musical tone signal e(t) is obtained in accordance with the following equation:

$$e(t) = A_1(t) \sin qR + A_2(t) \sin [l(t)qR + I_1(t) \sin(m(t)qR) + I_1(t) \sin(n(t)qR)] \quad (9)$$

It will be noted that this equation (9) is made by adding the term of the fundamental component $A_1(t)$ sin qR to the term of the frequency modulation $A_2(t)$ sin [l(t) qR+$I_1(t)$ sin (m(t)qR)+$I_2(t)$ sin(n(t)qR] which latter term is substantially equivalent to the equation (5). In the equation (9), the value qR represents the phase of the fundamental wave and the value $A_1(t)$ the peak amplitude of the fundamental wave component represented as a function of time t. Comparing the equation (9) with the equation (5), the phase $\alpha t$ of the carrier in the equation (5) is given by l(t) qR in the equation (9), that is, the phase of the carrier is obtained by multiplying the phase qR of the carrier by the time function l(t). The phase $\beta_1 t$ of the first modulating wave is given by the value m(t) qR, that is, it is obtained by multiplying the phase qR of the fundamental wave by the time function m(t). The phase $\beta_2 t$ of the second modulating wave is given by the value n(t) qR that is, it is obtained by multiplying the phase qR of the fundamental wave by the time function n(t). The first modulation index $I_1$ is represented by the time function $I_1(t)$, whereas the second modulation index $I_2$ is represented by the time function $I_2(t)$ so that these modulation indexes are varied with time. The value $A_2(t)$ is the peak amplitude of the modulated wave signal. It will be noted that this value $A_2(t)$ is represented as a function of time t so that the amplitude is varied with time.

The electronic musical instrument shown in FIG. 12 may be constructed substantially in the same manner as the instrument shown in FIG. 5 except for some additional circuits. Accordingly, the like component parts are designated by like reference characters throughout FIG. 5 and FIG. 12 and detailed description thereof will be omitted.

In the same manner as was previously described, a key assigner 2, frequency information memory 3 and counter 4 are operated in response to depression of the key on a keyboard 1, producing phase information qR assigned to the respective channels in a time-shared fashion. This phase information qR is supplied to processing systems A, B C and D. These processing systems A, B C and D implement computation of the fundamental wave component $A_1$ sin qR as the processing systems of the embodiment shown in FIG. 5 did, only difference being that the processing system D is additionally provided in the embodiment of FIG. 12.

In the processing system D, coefficient information n(t) generated by a modulating wave control signal generation circuit 110 and the phase information qR are multiplied with each other through a multiplier 100 and the output n(t)qR of the multiplier 100 is used for reading the second modulating wave signal sin(n(t)qR) from a sine waveform memory 120. The second modulation index information $I_2(t)$ provided by a modulation index control signal generation circuit 140 is multiplied with the second modulating wave signal sin(n(t)qR) in a multiplier 130 and a signal $I_2(t)$ sin(n(t)qR) is supplied to an adder 150. As the circuits 100–140 of the processing system D, the same circuit constructions as those employed in the circuits 10–14 of the processing system C may be employed.

In the processing system C shown in FIG. 12, a modulation index control signal generation circuit 14 produces the first modulation index information $I_1(t)$ while a multiplier 13 produces the signal $I_1(t)$ sin(m(t)qR). The adder 150 adds the phase information l(t) qR of the carrier provided by an adder 8, the output of a multiplier 13 and the output of a multiplier 130 together. A sine waveform memory 16 is accessed by the output of the adder 150 and the output of the memory 16 is multiplied with the amplitude information $A_2(t)$ in a multiplier 17 to obtain a frequency modulated signal $A_2(t)$ sin [l(t)qR+$I_1(t)$ sin(m(t)qR)+$I_2(t)$ sin (n(t)qR)]. This frequency modulated signal is added to the fundamental component signal $A_1(t)$ sin qR provided by a multiplier 6 in an adder 43 to obtain the musical tone signal e(t) which is a result of calculation of the equation (9). This musical tone signal e(t) is processed through circuits 44–48 in the same manner as was previously described and reproduced from a speaker 49.

HARMONIC LIMITING

In producing a frequency signal by sampling, it is known by the sampling theorem that harmonic components which are higher than half the sampling frequency are reflected into the audio domain to produce subharmonics. For preventing occurrence of such subharmonics, harmonic components higher than half the sampling frequency must be removed. In the above described embodiments, the frequency of the master clock $\phi_1$ is 1 MHz and waveforms of 12 tones are formed in a time shared fashion. A sampling frequency of one waveform therefore is 106/12≅80 kHz. Accordingly, signals above 40 kHz must be removed.

Frequency bandwidth BW in the frequency modulation system is generally expressed as $$BW \cong 2(d+m)$$

Since I=d/m, $$BW = 2m(I+1).$$

Although the bandwith BW is an entire bandwidth, the bandwidth to be dealt with here is only higher half of the bandwidth. Accordingly, the half-side bandwidth BWp is given by an equation $$BWp = m(I+1)$$

where m represents the modulating frequency and 1 the modulation index.

Accordingly, the highest frequency among frequency components having substantial amplitudes is C+BWp =C+m(I+1). C represents the carrier frequency. If this highest frequency is lower than 40 kHz, no subharmonics will be produced. Consequently, the basic condition of the harmonic limiting is $$C + m(I+1) \leqq 40 \text{ (kHz)} \quad (10)$$

A peak value M of the number of side frequencies contained in the frequency interval 40 (kHz)−C between the carrier C and the marginal frequency of 40 kHz is $$M = \frac{40(\text{kHz}) - C}{m}.$$

Accordingly, Mm=40 (kHz)−C. It will be apparent from this equation that no subharmonics are produced if the high-side bandwidth BWp is smaller than the value Mm. Then, the basic condition represented by the equation (10) can be simplified as follows:

$$m(I+1) \leqq 40\ (\text{kHz}) - C$$

$$m(I+1) \leqq Mm$$

Since m>0, $$I+1=M$$

$$I \leqq M-1 \qquad (11)$$

Accordingly, occurrence of subharmonics can be effectively prevented by determining the modulation index I at a value within a range which can satisfy the above equation (11).

In the embodiment shown in FIGS. 5, and 12, a harmonic limit circuit (not shown) may be additionally provided for detecting whether the equation (11) has been satisfied or not. Such harmonic limit circuit detects the frequencies of the carrier C and the modulating wave m on the basis of the frequency information R read from the frequency information memory 3 and the coefficient information l(t), n(t), n(t), I(t), $I_1$(t) and $I_2$(t), calculates the peak value M and thereby detects whether the equation (11) has been satisfied. If the equation (11) has not been satisfied, suitable adjustment may be made to satisfy the equation (11) such, for example, as reducing values of the modulation index information I(t), $I_1$(t) and $I_2$(t).

According to the present invention, the frequency modulation system to be used for production of a musical tone is not limited to the above described embodiment but other complicated frequency modulation systems (e.g. the equations (6) and (7)) may be employed. Modifications required for employing such other modulation systems may be realized by modifying the circuit shown in FIG. 5 and adding some computation system thereto.

If the sine waveform memories 5, 12 and 120 are substituted by memories storing waveforms containing abundant harmonic components such as a saw-tooth wave, triangular wave and rectangular wave, waveforms containing abundant harmonic components can be used as the carrier component or the modulating component whereby a musical tone containing more complicated harmonic components can be obtained.

Theoretical explanation of a case where a waveform containing abundant harmonic components such as a triangular wave is used as the modulating wave will now be given.

In this case, amplitude e(t) of a frequency modulated signal wave is expressed by the following equation.

$$e(t)=A(t)\sin[l(t)\omega t+I(t)f(m(t)\omega t)] \qquad (12)$$

where A(t) represents a peak amplitude which is a function of time ω an angular frequency of the fundamental wave and values l(t) and m(t) functions values of which vary with time. Accordingly, l(t)ω represents the angular frequency of the carrier and m(t)ω the angular frequency of the modulating wave. The frequencies of both carrier and modulating waves can be varied with time as desired. I(t) represents the modulation index which is also given as a function of time. f(m(t)ωt) represents the modulating wave component, signifying that the modulating wave component is given by a function f in which a variable is m(t)ωt. This function f in this case is a function other than a sine function or a cosine function.

In the present embodiment, evolution of the modulated signal e(t) is much more complicated than in the case of the previously described embodiment and a signal containing a number of harmonics in complicated relative positions and amplitudes can be obtained. If, for example, a function of a saw-tooth wave is used as the function of the modulating wave, the equation (12) is substituted by the following equation (13) in which the modulation index I(t) is substituted by a constant I for convenience of explanation:

$$\begin{aligned} e(t) &= A(t)\sin[\omega ct + I f(\omega\, mt) \qquad (13) \\ &= A(t)\sin\Big[\ \omega ct + \\ &\quad I\Big(\sin\omega\, mt + \tfrac{1}{2}\sin 2\, mt + \tfrac{1}{3}\sin 3\omega\, mt + \\ &\quad \tfrac{1}{4}\sin 4\omega\, mt + \tfrac{1}{5}\sin 5\omega\, mt + \ldots\Big)\Big] \end{aligned}$$

where ω ct represents the phase component l(t)ω t of the carrier, ω mt the phase component m(t)ω t of the modulating wave.

The above equation (13) signifies that harmonics sin ω mt, sin 2ω mt, sin 3ω mt . . . contained in the saw-tooth wave f(ω mt) are used as the modulating waves for concurrently frequency-modulating the single carrier sin ω ct with different modulation indexes I, ½I, ⅓I, ¼I . . . . Accordingly, the modulated signal wave e(t) consists of many complicated side frequencies which constitute a multiple side frequency spectrum in which, for example, one side frequency occurs about another side frequency. The amplitudes of these side frequencies are determined by Bessel functions $J_0$(I), $J_1$(I), . . . $J_n$(I), $J_0$I/2, $J_1$I/2, . . . $J_n$I/2, . . . $J_0$I/n, $J_1$I/n, . . . $J_n$I/n, of the modulation indexes I, I/2, I/3, I/4 I/5 . . . I/n. Accordingly, considerably complicated harmonic relations are obtained by the equation (13).

If a triangular wave, a rectangular wave or the like is used as the modulating wave instead of the saw-tooth wave, the carrier sin ω ct is frequency-modulated concurrently by harmonic components contained in such modulating wave with different modulation indexes in the same manner as in the case where the saw-tooth wave is employed. Accordingly, a musical tone obtained according to the equation (12) by far surpasses the musical tone obtained by the previously described embodiment in the number of harmonics and in the degree of complexity in relative positions of the harmonics.

The basic formula shown in the above equation (12) or (13) may be expanded in various ways.

If, for example, a single carrier sin $\omega$ ct is modulated by two modulating wave functions $f_1(\omega m_1 t)$, $f_2(\omega m_2 t)$, the modulated signal wave $e_1(t)$ becomes $$e_1(t)=A(t)\sin[\omega ct+I_1f_1(\omega m_1t)+I_2f_2(\omega m_2t)] \quad (14)$$

where $I_1$, $I_2$ are modulation indexes. The equation (14) represents a frequency modulation system according to which the carrier is modulated concurrently by a large number of harmonics contained in the two functions in an extremely complicated manner. In this case, even more complicated harmonic relations than in the equation (12) or (13) can be produced.

If the carrier sin $\omega$ ct of the same frequency is separately modulated by the two modulating wave function $f_1(m_1t)$ and $f_2(m_2t)$, a modulated signal wave $e_2(t)$ becomes.

$$e_2(t)=A(t)\{\sin[\omega ct+I_1f_1(\omega m_1t)]+\sin[\omega ct+I_2f_2(\omega m_2t)]\} \quad (15)$$

This signal $e_2(t)$ is the same as a signal obtained by superposing the two different signals obtained by the equation (12) or (13).

If the carrier is synthesized by two different angular frequencies $\omega C_1$, $\omega C_2$ and modulated by a single modulating wave function f($\omega$ mt), modulated signal wave $e_3(t)$ becomes $$e_3(t)=A(t)\sin[\omega c_1t+\omega c_2t+If(\omega nt)]$$

A musical tone may be produced by utilizing the complicated frequency modulation system represented by the equations (13)–(16).

Modified embodiments of the invention will now be described with reference to FIGS. 13 and 14. Difference in construction between the present embodiments and the previously described one resides in that the sine waveform memories 5 and 12 are substituted by function waveform memories 5X and 12X in the present embodiments. Construction and operation for applying address signals to these memories 5X and 12X are the same as in the previously described embodiment. As for computation operations in response to respective outputs, only difference resides in the computation formula and details of the computation operations are the same as in the previously described embodiment. Detailed description of such construction and operations will therefore be omitted.

Figure 13:
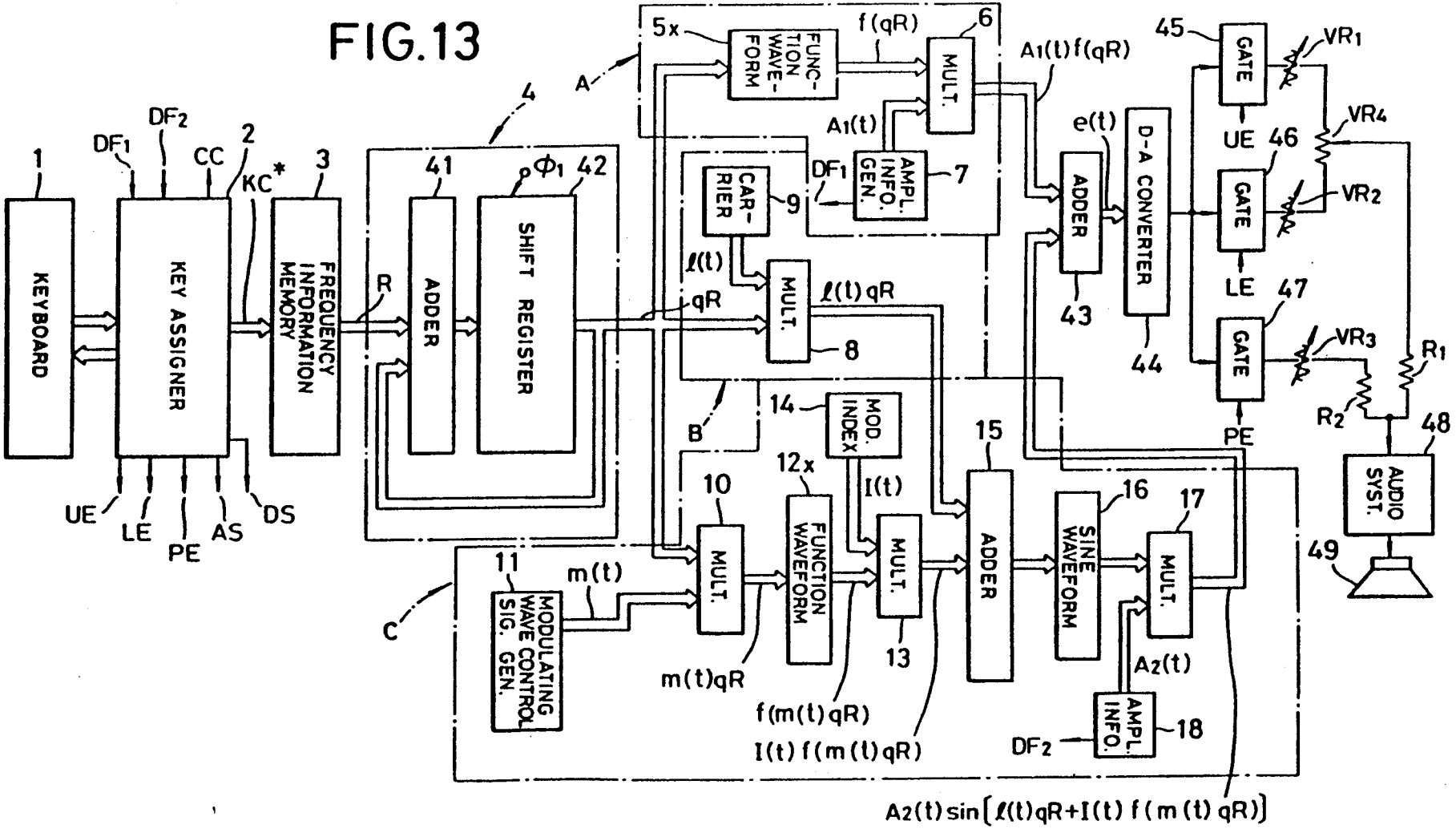
FIG. 13 is a block diagram showing another embodiment of the invention in which a waveform other than a sine waveform is used as the modulating wave.

In the embodiment shown in FIG. 13, a musical tone e(t) is obtained by the following equation (17):

$$e(t)=A_1(t)f(qR)+A_2(t)\sin[l(t)qR+I(t)f(m(t)qR)] \quad (17)$$

The equation (17) is obtained by adding the term of the fundamental wave component $A_1(t)f(qR)$ to the equation (12). The term of the fundamental wave component is provided for preventing loss of the fundamental wave component as was previously described. In the equation (17), the value qR represents the phase of the fundamental wave and corresponds to the value t in the equation (12). If a waveform such as a triangular wave which contains abundant harmonic components is used as the function f(qR), harmonics in the musical tone signal can be further increased. The amplitude coefficient $A_1(t)$ is a peak amplitude of the function waveform f(qR) of the fundamental wave component expressed a function of time t.

The phase $l(t)\omega$ t of the carriers is given by a value l(t)qR which is obtained by multiplying the phase qR of the fundamental wave with the time function l(t). The phase $m(t)\omega$ t of the function waveform of the modulating wave is given by a value m(t)qR which is obtained by multiplying the phase qR of the fundamental wave with the time function m(t). I(t) represents the modulation index. The amplitude coefficient $A_2(t)$ represents the modulation index. The amplitude coefficient $A_2(t)$ is a peak amplitude of the frequency modulated signal wave portion. Conditions of the waveform of the modulating wave function f(m(t)qR) are the same as in the equation (12).

The function waveform memory 5X which is constructed of a suitable memory device, e.g. a read-only memory, stores the function waveform f(qR) of the fundamental wave component. If a saw-tooth waveform for example is used as the function f(qR), the saw-tooth waveform is stored. Information qR is applied to the function waveform memory 5X as an address input and, consequently, the function waveform f(qR) is provided by a processing system A.

In a processing system B, phase information l(t)qR of the carrier component is computed in the same manner as was previously described.

In a processing system C, the phase information m(t)qR of the modulating wave component is provided by a multiplier 10. This phase information is applied to the function waveform memory 12X. The memory 12X is of a similar construction to the memory 5X, storing a waveform containing abundant harmonic components. The memory 12X produces an output f(m(t)qR) which is thereafter processed for computation in the same manner as in the previously described embodiment. Consequently, a multiplier 17 produces a modulated signal wave controlled in amplitude $A_2(t)$ sin [l(t)qR+1(t)f(m(t)qR)].

This modulated signal wave and the fundamental wave component signal $A_1(t)$ f(qR) provided by the multiplier 6 are applied to an adder 43 and added together. The adder 43 produces a musical tone signal e(t) which is a result of computation according to the equation (15) in the form of a digital signal. This signal is converted to an analog signal through a digital-to-analog converter, gate-controlled and volume controlled keyboard by keyboard and thereafter is reproduced through an audio system 48 and a speaker 49.

Figure 14:
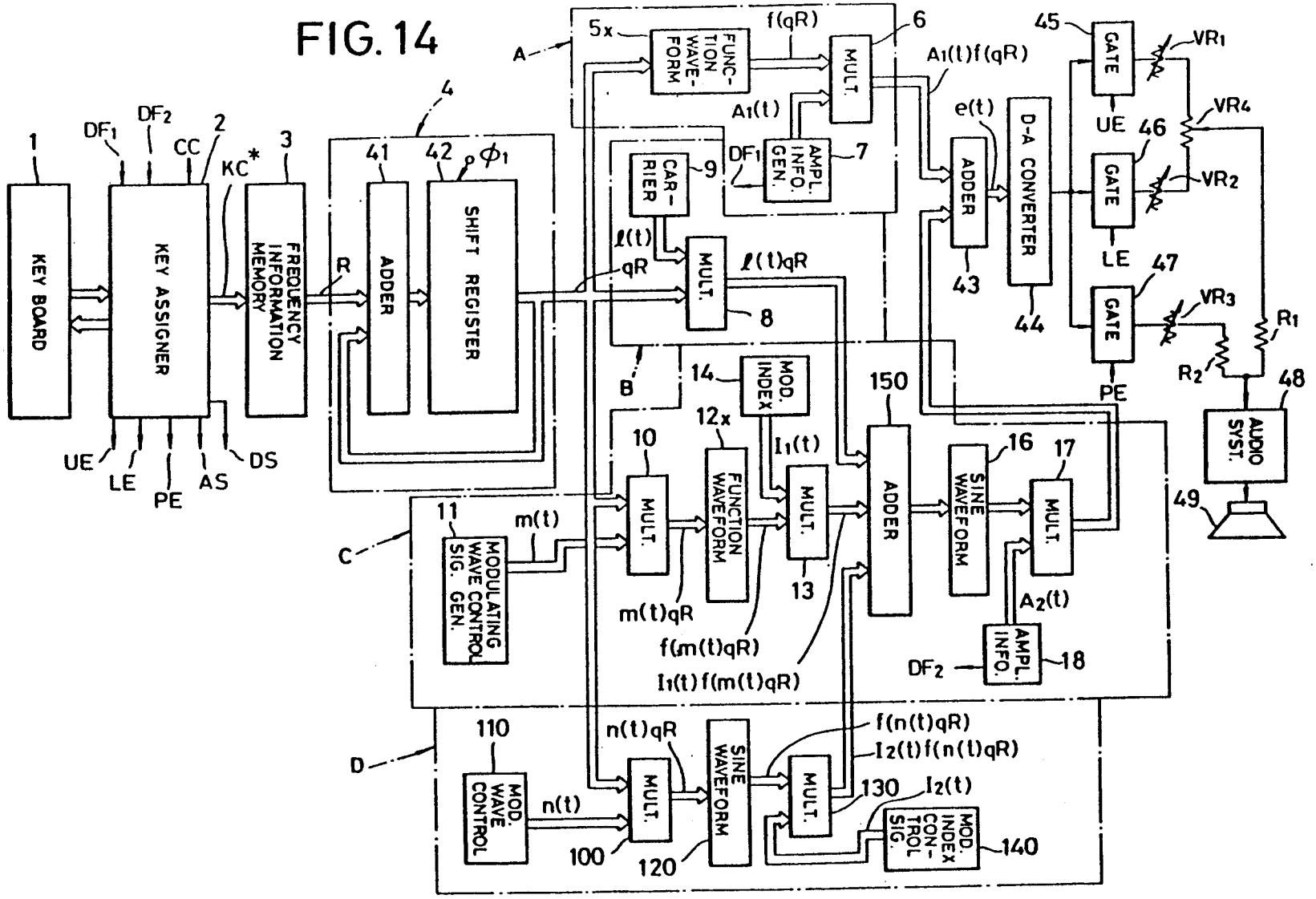
FIG. 14 is a block diagram showing still another embodiment of the invention using a waveform other than a sine waveform as the modulating wave.

In the embodiment shown in FIG. 14, a musical tone is produced by utilizing the frequency modulation system according to the equation (14) and is obtained by the following equation (18):

$$e(t) = A_1(t)f(qR) + A_2(t)\sin[l(t)qR + I_1(t)f(m(t)qR) + I_2(t)f(n(t)qR)] \quad (18)$$

The equation (18) is made up by adding the term of the fundamental wave component $A_1(t)f(qR)$ to the term of the frequency modulation $A_2(t)$ sin [l(t)qR+$I_1$(t)f(m(t)qR)+$I_2$(t)f(n(t)qR)] which corresponds to the equation (14). In the equation (18), the value qR represents the phase of the fundamental wave and the value $A_1(t)$ represents the peak value of the fundamental wave component in the form a function of time t. Comparing the equation (14) with the equation (18), the phase $\omega$ ct of the carrier is given by l(t)qR which is obtained by multiplying the phase qR of the fundamental wave with the time function l(t). The phase $\omega$ $m_1$t of the first modulating wave is given by the value m(t) qR which is obtained by multiplying the phase qR of the fundamental wave with the time function m(t). The phase $\omega$ $m_2t$ of the second modulating wave is given by the value n(t)qR which is obtained by multiplying the phase qR of the fundamental wave with the time function n(t). The first modulation index $I_1$ is represented by the time function $I_1(t)$ and the second modulation index $I_2$ by the time function $I_2(t)$ so that they will vary with time. The value $A_2(t)$ is the peak amplitude of the frequency modulated signal expressed as a function of time t, signifying that the amplitude varies with time.

The embodiment of FIG. 14 may be constructed in substantially the same manner as the embodiment of FIG. 13 except for same additionally provided circuits, so that like component parts are designated by like reference characters throughout FIGS. 13 and 14 and detailed description will be omitted.

In the same manner as in the previously described embodiments, the phase information qR is supplied to processing system A, B, C and D. The processing system A calculates, as in the embodiment of FIG. 13, the funcamental wave component $A_1f(qR)$. In processing systems B, C and D, computation of the frequency modulation is implemented. Difference from the embodiment of FIG. 13 is the additional provision of the processing system D.

In the processing system D, the coefficient information n(t) generated by a modulating wave control signal generation circuit 110 is multiplied with the phase information qR in a multiplier 100 and a function waveform f(n(t)qR) of a second modulating wave is read from a function waveform memory 120 in response to the output n(t)wR of the multiplier 100. The second modulation index information $I_2(t)$ generated by a modulation index control signal generation circuit 140 is multiplied with the second modulating wave signal f(n(t)qR) in a multiplier 130 and the signal $I_2(t)f(n(t)qR)$ is supplied to an adder 150. The circuits 100–140 in the processing system D may be constructed in the same manner as the corresponding circuits 10–14 in the processing system C.

In the processing system C shown in FIG. 14, a multiplier 13 of a modulation index control signal generation circuit 14 produces a signal $I_1(t)f(m(t)qR)$. An adder 150 is provided for adding the phase information e(t)qR of the carrier provided by the multiplier 13, the output of the multiplier 13 and the output of the multiplier 130 together. A sine waveform memory 16 is accessed by the output of the adder 150. The output of the sine waveform memory 16 is multiplied with the amplitude information $A_2(t)$ in a multiplier 17 to produce the frequency-modulated signal $A_2(t)$ sin $[l(t)qR+I_1(t)f(m(t)qR)+I_2(t)f(n(t)qR)]$. This frequency-modulated signal is added in an adder 43 to the fundamental wave component signal $A_1(t)f(qR)$ provided by a multiplier 6 to produce the musical tone signal e(t) which is a result of computation of the equation (9). This musical tone signal e(t) is processed through circuits 44–48 and reproduced from a speaker 49.

I claim:

1. An electronic musical instrument comprising:

first means for detecting depressed keys and assigning respective tones corresponding to the depressed keys to any of a predetermined plurality of channels;

second means for generating, for each assigned channel, phase information whose value changes at a rate corresponding to the frequency of the musical tone associated with said each assigned channel;

third means for forming in a time-shared manner, for each assigned channel and based upon the respective phase information generated by the second means, carrier phase information indicative of the phase of a carrier wave and modulation information for modulating said carrier wave information and for producing, in a time-shared manner for each assigned channel and based on said carrier phase information and said modulation information and a modulation index, a wave signal representative of the modulation of the carrier wave by the modulation information, which modulation causes the wave signal to include plural harmonic components, and sending out said wave signal as a musical tone signal;

wherein a plurality of tones are generated simultaneously corresponding to respective musical tone signals sent out from said third means.

2. An electronic musical instrument according to claim 1 wherein, in said third means, said modulation wave phase information is used to produce a modulation wave of sinusoidal form.

3. An electronic musical instrument according to claim 1 wherein, in said third means, said modulation wave phase information is used to produce a modulation wave of non-sinusoidal form.

4. An electronic musical instrument according to claim 3 wherein said non-sinusoidal form is saw-tooth.

5. An electronic musical instrument according to claim 3 wherein said non-sinusoidal form is triangular.

6. An electronic musical instrument according to claim 3 wherein said non-sinusoidal form is rectangular.

7. An electronic musical instrument comprising:

a first circuit for generating as a modulation index a function I(t) whose value varies with passage of time;

a second circuit for generating as a modulation wave a function waveform which contains a plurality of harmonic components;

a third circuit for generating a signal representing the frequency of a carrier wave the frequency of which varies with passage of time for a single note to be generated;

a fourth circuit for carrying out frequency modulation on said signal generated at said third circuit by using outputs of said first and second circuits and for outputting said frequency-modulated signal as a musical tone signal, wherein the modulating wave and carrier wave have relative frequencies such that the frequency modulation operation carried out by the fourth circuit causes the musical tone signal to be imparted with harmonic components.

8. An electronic musical instrument according to claim 7, wherein said function waveform is a saw-tooth wave containing harmonic components.

9. An electronic musical instrument according to claim 7, wherein said function waveform is a triangular wave containing harmonic components.

10. An electronic musical instrument according to claim 7, wherein said function waveform is a rectangular wave containing harmonic components.

11. An electronic musical instrument according to claim 7, wherein the frequency of said function waveform is varied with time.

* * * * *